US008939572B2

(12) United States Patent
Perez Gellida et al.

(10) Patent No.: US 8,939,572 B2
(45) Date of Patent: Jan. 27, 2015

(54) CONTROL OF AIR-BASED MEDIA DRYER

(71) Applicant: Hewlett-Packard Development Company, L.P., Fort Collins, CO (US)

(72) Inventors: Francisco Javier Perez Gellida, Sant Cugat (ES); Roger Bastardas Puigoriol, Sant Just Desvern (ES); Mikel Zuza Irurueta, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 37 days.

(21) Appl. No.: 13/767,105

(22) Filed: Feb. 14, 2013

(65) Prior Publication Data

US 2014/0225955 A1 Aug. 14, 2014

(51) Int. Cl.

| | |
|---|---|
| ***B41J 2/01*** | (2006.01) |
| ***B41J 11/00*** | (2006.01) |
| ***F26B 25/00*** | (2006.01) |

(52) U.S. Cl.

CPC ..... *B41J 11/002* (2013.01); *F26B 25/00* (2013.01)

USPC ..... 347/102; 347/5; 347/17; 347/19

(58) Field of Classification Search

None

See application file for complete search history.

(56) References Cited

U.S. PATENT DOCUMENTS

| | | | |
|---|---|---|---|
| 6,227,961 | B1 | 5/2001 | Moore et al. |
| 6,994,620 | B2 | 2/2006 | Mills |
| 2008/0304229 | A1 | 12/2008 | June et al. |
| 2012/0215359 | A1 | 8/2012 | Michael et al. |

FOREIGN PATENT DOCUMENTS

| | | |
|---|---|---|
| KR | 20020048695 | 6/2002 |
| KR | 20080048694 | 6/2008 |

OTHER PUBLICATIONS

Kim, et al. Analysis of Convective Thermal Resistance in Ducted Fan-Heat Sinks. IEEE Transactions on Components and Packaging Technologies, vol. 29, No. 3, Sep. 2006.

*Primary Examiner* — Justin Seo

(74) *Attorney, Agent, or Firm* — Hewlett-Packard Patent Development

(57) ABSTRACT

Examples are provided of controlling sheet media dryers. A controller operates a fan at plural duty cycles and correlates a resulting air pressure to each to define empirical data pairs. A parabolic curve fit to the empirical data is used to derive additional data pairs, and a lookup table is defined using the empirical and derived data pairs. The controller uses the lookup table to operate the fan during normal operations of a sheet media dryer.

15 Claims, 4 Drawing Sheets

CONTROL OF AIR-BASED MEDIA DRYER

BACKGROUND

Ink-jetting printers form images on media using one or more colors of liquid ink. Some ink media require drying or curing to ensure print quality without smudges or other undesirable effects that can result from user handling, contact with other sheet media, and so on. The present teachings address the foregoing and related concerns.

BRIEF DESCRIPTION OF THE DRAWINGS

The present embodiments will now be described, by way of example, with reference to the accompanying drawings, in which.

DETAILED DESCRIPTION

Introduction

Systems and methods are provided related to controlling sheet media dryers. A controller operates a fan at plural duty cycles and correlates a resulting, respective air pressure to each duty cycle so as to define empirical data pairs. A parabolic curve is fitted to the empirical data and is used to derive additional data pairs. A lookup table is defined using the empirical and derived data pairs. The controller uses the lookup table to operate the fan during normal operations of a sheet media dryer.

In one example, a method is performed using a controller for a drying system, the method including driving a fan at a plurality of distinct duty cycles. The method also includes correlating each of the duty cycles with a resulting air pressure to define empirical data pairs. Additionally, the method includes calculating derived data pairs by way of a parabolic curve fit through the empirical data pairs, and defining a lookup table including the empirical data pairs and the derived data pairs. The method further includes operating the fan in accordance with a media to be dried by way of the lookup table.

In another example, a system includes a pressure sensor to sense static pressure within a manifold of an air-based media dryer and to provide a corresponding signal. The system also includes a fan to drive air flow through the manifold. The system further includes a controller coupled to the pressure sensor and the fan. The controller is configured to operate the fan at a plurality of duty cycles and correlate each with a resulting pressure to define respective empirical data pairs. The controller is also configured to derive one or more data pairs using a parabolic curve fit through the empirical data pairs. The controller is further configured to define a lookup table including the empirical and the derived data pairs, and to control the fan by way of the lookup table.

In still another example, a printing apparatus includes a master controller, and a print engine for forming images on sheet media using ink. The print engine is controlled by the master controller. The printing apparatus also includes an air-based dryer for drying ink deposited onto sheet media. The air-based dryer is coupled to the master controller. The air-based dryer includes a pressure controller and a temperature controller. The pressure controller is configured to generate a lookup table of empirical data pairs and derived data pairs. Each of the data pairs includes a fan duty cycle correlated to an air pressure value. The pressure controller is also configured to use the lookup table to control air pressure within the air dryer during operation of the printing apparatus.

First Illustrative System

Figure 1:
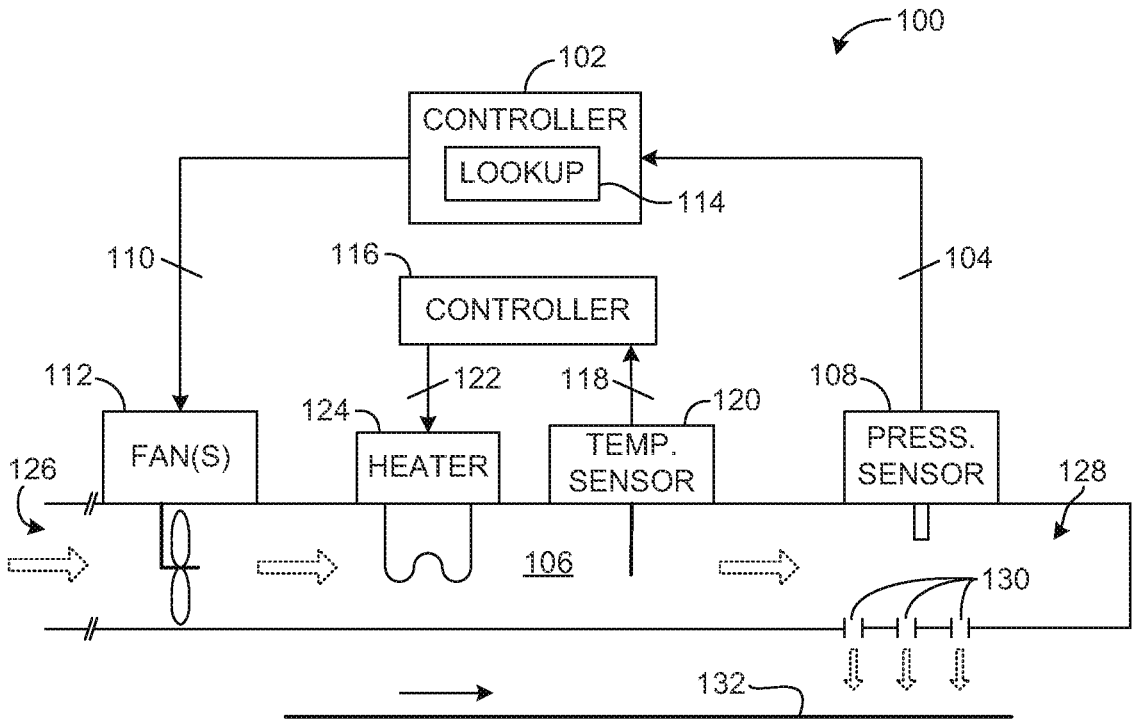
FIG. 1 depicts a block diagram of system for drying sheet media according to one example of the present teachings.

Reference is now directed to FIG. 1, which depicts a system 100. The system 100 is illustrative and non-limiting with respect to the present teachings. Thus, other systems can be configured and/or operated in accordance with the present teachings. The system 100 defines, at least in part, a hot air drying system 100 in accordance with the present teachings.

The system 100 includes a pressure controller 102. The pressure controller 102 is configured to receive signaling 104 corresponding to a fluid pressure (i.e., air) within a manifold 106 from a pressure sensor 108. The pressure controller 102 is also configured to provide a control signal 110 to control (i.e., modulate, or adjust) the duty cycle (i.e., running speed) of one or more fans 112. The fan(s) 112 can be defined by various bladed forms, or "bladeless" forms such as the "Dyson Air Multiplier™" available from Dyson Inc., Chicago, Ill., USA. Other suitable forms of fan 112 can also be used.

The pressure controller 102 can be defined by or include any suitable constituency including, without limitation, a processor, a microcontroller, application-specific integrated circuitry (ASIC), and so on. In one example, the control signal 110 is formatted as a pulse-width modulated (PWM) control signal characterized by a duty cycle (e.g., zero to one-hundred percent). In another example, the fan(s) 112 are controlled by way of tachometric feedback.

The pressure controller 102 further includes a lookup table 114 stored in machine-accessible storage media. The lookup table 114 includes respective data pairs, each including a fan duty cycle correlated to an air pressure. The data pairs are determined and stored in accordance with the present teachings and as described hereinafter. The sensor 108 and the pressure controller 102 and the fan(s) 112 defined a closed-loop control system with respect to air pressure within the manifold 106.

The system also includes a temperature controller 116. The temperature controller 116 is configured to receive signaling 118 corresponding to a fluid temperature (i.e., air) within the manifold 106 from a temperature sensor 120. The temperature controller 116 is also configured to provide a control signal 122 to control (i.e., modulate, or adjust) an electric heater (or heaters) 124. The temperature controller 116 can be defined by or include any suitable constituency including, without limitation, a processor, a microcontroller, an ASIC, and so on. The temperature sensor 120 and the temperature controller 116 and the heater(s) 124 defined a closed-loop control system with respect to air temperature within the manifold 106.

The system 100 further includes the manifold 106 introduced above. The manifold 106 can be formed from any suitable material such as plastic, aluminum, and so on. The manifold 106 is characterized by an open inlet end or "maw" 126 through which ambient air (or another fluid) can enter. The manifold 106 further includes a terminal end portion (or zone) 128. A manifold 106 is also characterized by a plurality of ports (through apertures) 130 configured to direct fluid flow (i.e., heated air) outward from the manifold 106 toward a sheet media 132 bearing ink imaging formed thereon. In one example, the ports 130 are distributed throughout an area or "swath" consistent with a width-wise aspect of the sheet media 132. Other configurations can also be used.

Typical, normal operation of the system 100 is generally as follows: Upon startup, the temperature controller 116 causes the heater 124 to operate by way of control signaling 122. The temperature sensor 120 provides temperature signaling 118 to the temperature controller 116, and the temperature controller 116 modulates the control signaling 122 so as to maintain the sensed temperature at (or nearly so) a predetermined temperature set-point.

The pressure controller 102 causes the fan or fans 112 to operate by way of control signaling 122. The pressure sensor 108 provided pressure signaling 104 to the pressure controller 102, which responds by modulating the PWM control signaling 110 in order to maintain the sensed air pressure at, or within a predetermined tolerance of, a pressure set-point. The pressure set-point can be determined in accordance with a media 132 type to be dried (or cured), a type of ink or inks on the media 132 to be cured, and so on.

The pressure controller 102 is configured to perform a calibration procedure so as to define empirical and derived data pairs, which in turn are used to control the fan (or fans) 112 during normal operations. Such calibration can be performed periodically, during a device or apparatus startup process, or in accord with another stratagem.

The pressure controller 102 is also configured to determine (or calculate) a present fan duty cycle based upon a corresponding air pressure to be provided within the manifold 106. The pressure controller 102 can reference the empirical data pairs or derived data pairs directly, or interpolate between respective data pairs, in order to calculate such a present duty cycle. Such referencing or interpolating can be repeated in accordance with changes in sheet media or ink to be dried, changes in ambient conditions (e.g., humidity or atmospheric air pressure), and so on. Furthermore, the pressure controller 102 can incrementally increase or decrease a presently used fan duty cycle until a resulting (sensed) pressure within the manifold 106 is within a predetermined tolerance.

Illustrative Duty Cycle/Air Pressure Curve

Figure 2:
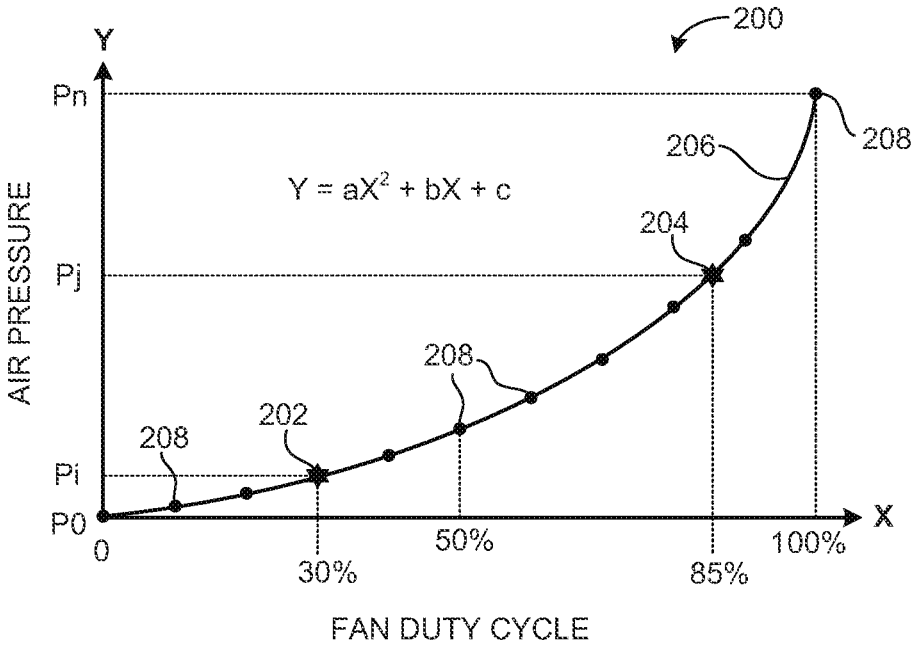
FIG. 2 depicts a curve fit through data pair values according to another examples of the present teachings.

Attention is now directed to FIG. 2, which depicts a fan duty cycle and air pressure relationship curve 200 defined in accordance with respective data pairs according to the present teachings. The curve 200 is illustrative and non-limiting with respect to the present teachings, and other curves, having other numbers of correlated data pairs, or fit by other mathematical functions, can also be used. As depicted, the "X" axis corresponds to fan duty cycle (independent variable), and the "Y" axis corresponds to sensed air pressure resulting or predicted at the given fan duty cycle (dependent variable).

The curve 200 includes an empirical data pair 202 defined by a duty cycle of thirty percent and a resulting air pressure "Pi". The data pair 202 is defined (or determined) by operating a fan or fans (e.g., 112) at a thirty percent (30%) duty cycle, and then sampling the resulting air pressure signal (e.g., 104). The correlated duty cycle/air pressure values defines the data pair 202. The curve 200 also includes an empirical data pair 204 defined by a duty cycle of eighty-five percent (85%) and a resulting air pressure "Pj", which is determined in a manner analogous to that of the data pair 202. In one example, air pressure is measured in inches of water column. Other suitable pressure units can also be used.

The curve 200 also includes a parabolic curve (or function) 206 that is calculated to fit through the origin (zero point) and the two respective empirical data pairs 202 and 204. The parabolic function 206 is generally of the form: $Y=aX^2+bX+c$. When fitting through the origin, the constant (c) is zero by inspection and thus eliminated from the curve fitting function 206. Once the respective coefficients (a, b) are determined by known techniques, the resulting function 206 can be used to calculate any suitable number of derived data pairs 208. As depicted, the curve 200 includes nine derived data pairs 208 (not counting the origin) calculated at ten percent increments of the fan duty cycle (i.e., 10%, 20%, 40%, and so on).

The curve 200 depicts a total of twelve data pairs (or points), including the origin, plotted in a Cartesian coordinate system, with each data pair consists of: (duty cycle, air pressure). These respective data pairs, empirical and derived, can be used to construct or define a lookup table (e.g., 114). Other lookup tables, having any suitable respective number of duty cycle/air pressure data pairs can be defined and used, as can other (non-parabolic) fitting functions,

Second Illustrative System

Figure 3:
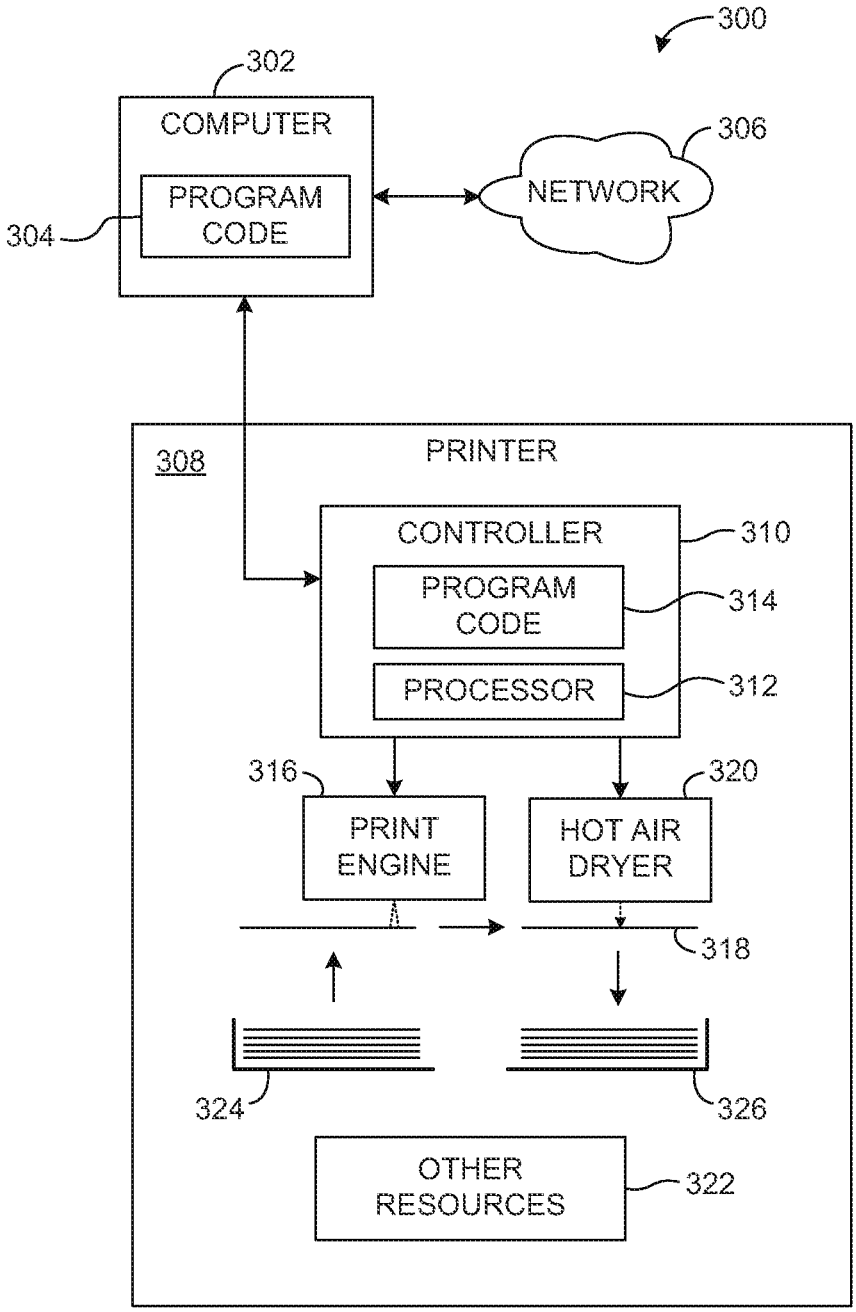
FIG. 3 depicts a block diagram of a system including a sheet media dryer in accordance with the present teachings.

Attention is now turned to FIG. 3, which depicts a system 300 in accordance with another example of the present teachings. The system 300 is illustrative and non-limiting, and other systems, apparatus, devices and configurations can also be used.

The system 300 includes a computer 302. The computer 302 can be variously defined and in one example, is a general-purpose desktop computer operating in accordance with a machine-readable program code 304. The program code 304 is stored on tangible, machine-accessible media such as a non-volatile memory, an optical disk, a magnetic disk, and so on. The computer 302 is connected for bidirectional communication with a network 306. In one example, the network 306 includes connection (or access) to the Internet. Other network structures can also be used.

The system 300 also includes a printer 308. The printer 308 includes a controller (or master controller) 310 configured to control numerous normal operations of the printer 308. The controller 310 can be variously defined or inclusive of any suitable electronic circuitry. As depicted, the controller is at least partially defined by a processor 312 configured to operate according to a machine-readable program code 314. In turn, the program code 314 is stored on suitable, machine-accessible tangible media.

The printer 308 also includes a print engine 316 configured to form images on sheet media 318 using ink or another liquid media. The print engine 316 can be variously defined and operation thereof is controlled by signaling from the controller 310. In one illustrative example, the print engine 316 is defined by a page-wide ink-jetting array configured to form images in one or more respective colors. Other suitable print engines can also be used.

The printer 308 also includes a hot air dryer (dryer) 320. The dryer 320 is coupled to communicate data or control signals with the controller 310. The dryer 320 is configured to dry (or cure) ink on sheet media 318 using hot air provided from a manifold. The dryer 320 is also configured to be calibrated and operated in accordance with the present teachings. In one example, the dryer 320 is equivalent (or analogous) to the hot air drying system 100 described above.

The printer 308 also includes other resources 322. Such other resources 322 can include any suitable elements, subsystems and the like to perform respective functions. Non-limiting examples of other resources 322 include a display screen, an operator interface, wireless communications circuitry, a memory media interface, sheet media transport mechanisms, a sheet media type-identification system, atmospheric air pressure or humidity sensing devices, a power supply, and so on. Respective ones of the other resources 322 can be coupled to the controller 310, the print engine 316, and so on, as needed so as to perform their normal functions. Such couplings or communication pathways are omitted from FIG. 3 in the interest of clarity.

Typical, non-limiting, normal operations of the system 300 are illustrated as follows: a user of the computer 302 retrieves an electronic document file from the network 306. Such a file could be, for example, a document generated by way of a word processing application. The user provides input to the computer 302 so as to cause printing of the document on paper media. The computer 302 communicates corresponding data to the master controller 310 of the printer 308 by way of electronic signaling.

The controller 310 provides respective control signals to the print engine 316, the dryer 320, and other resources 322, as needed, to cause printing of the document. In particular, sheet media is drawn one sheet at a time from a supply tray 324. Images in ink media are formed on the respective sheets, resulting in printed sheet media 318, which are then transported into operative proximity to the dryer 320.

The dryer 320 produces a stream (ribbon, or band) of heated air that flows onto the ink bearing surface of the printed media 318. The ink media thereon is cured or affixed (or both) to the printed sheet media 318, which are then accumulated in a receiving tray 326. The printing operation is complete when all sheet media 318 required by the present printing task have been imaged and cured, accordingly.

During printing and curing operations, the controller 310 provides information to the dryer 320 regarding the characteristics or type of the sheet media or ink(s) to be dried (or cured). In turn, a pressure controller (e.g., 102) within the air dryer 320 determines an air pressure appropriate to the printed media 318 and operates the fan (or fans) at a corresponding duty cycle. Such duty cycle determination can be found by direct reference to data pairs within a lookup table (e.g., 114), by interpolation between data pairs therein, and so on, according to the present teachings. The air dryer 320 is also configured to perform a calibration procedure to construct such a lookup table (set of data pairs) according to the present teachings.

Illustrative Method

Figure 4A:
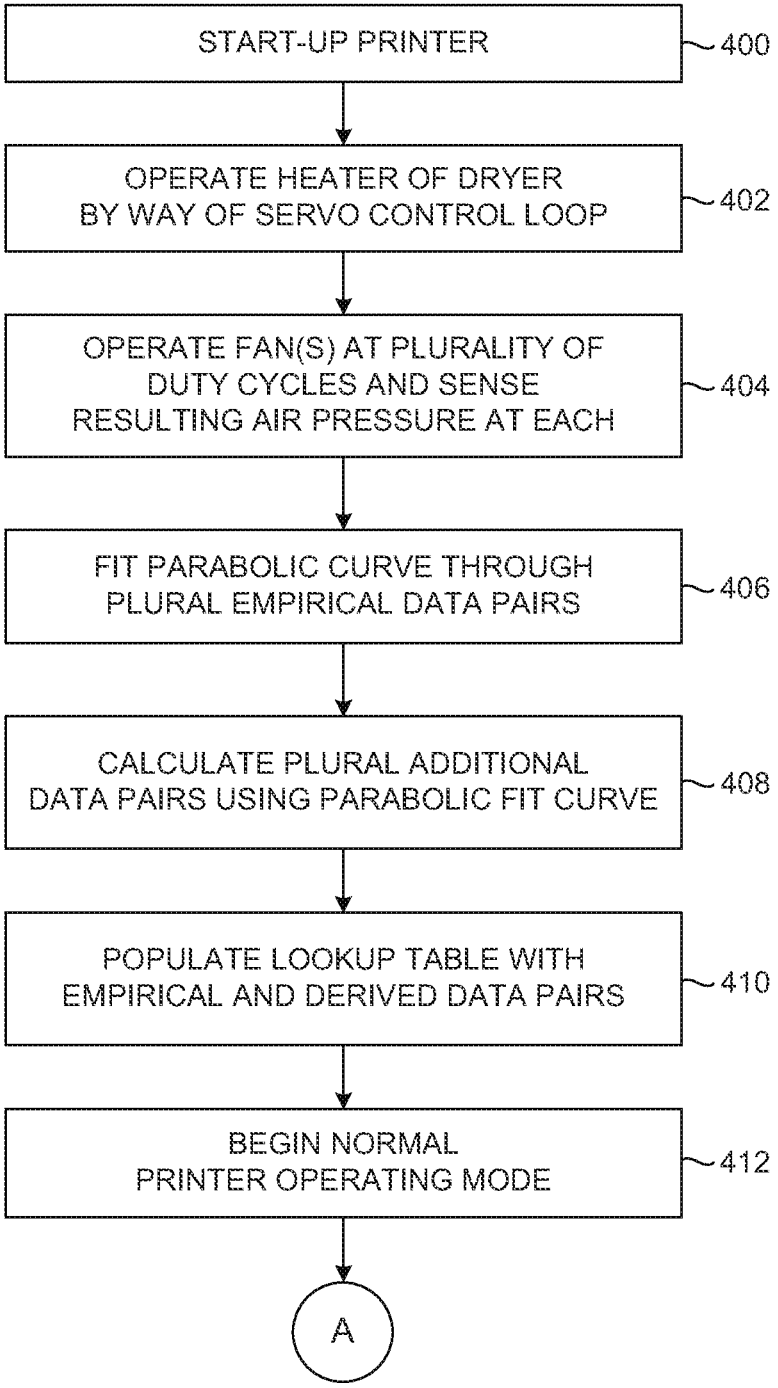
FIGS. 4A and 4B collectively depict a flow diagram of a method according to another example.
Figure 4B:
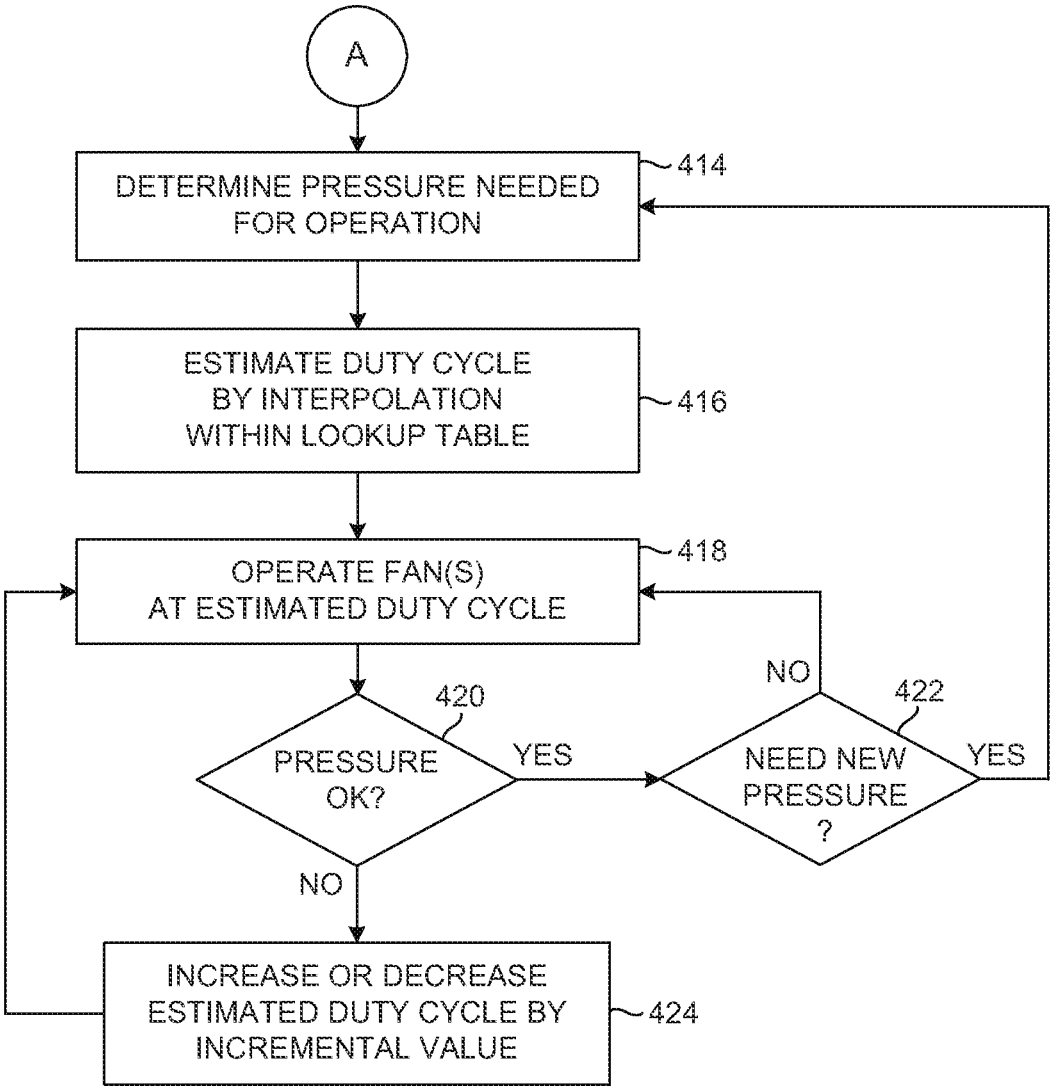

Reference is made now to FIGS. 4A and 4B, which collectively depicts a flow diagram of a method according to the present teachings. The method of FIGS. 4A-4B includes particular steps performed in a particular order of execution. However, other methods including other steps, omitting one or more of the depicted steps, or proceeding in other orders of execution can also be defined and used. Thus, the method of FIGS. 4A-4B is illustrative and non-limiting with respect to the present teachings. Reference is also made to FIGS. 1, 2 and 3 in the interest of illustrating the method of FIGS. 4A-4B.

At 400, a printer is started up. For purposes of a present example, the printer 308 is turned on (activated) in preparation for normal printing operations. Various elements and resources of the printer 308 are energized and begin any respective startup procedures that each has.

At 402, a heater of a hot air dryer is operated by way of servo loop control. In the present example, the dryer 320 of the printer 308 includes an electric heater 124 controlled by a temperature controller 116 in accordance with a temperature sensor 120. The controller determines (or defaults) to an operating temperature and modulates control signaling 122 to the heater 124 to maintain heated air within the manifold 106 at (or near) a set-point temperature.

At 404, a fan or fans are operated at a plurality of duty cycles and a resulting air pressure for each is sensed. In the present example, the pressure controller 102 begins a calibration procedure. The pressure controller 102 drives the fan(s) 112 at two distinct duty cycles such as, for non-limiting example, thirty percent and eighty-five percent, by way of PWM signaling 110. The pressure controller 102 receives pressure measurement (sensing) signaling 104 from the sensor 108, which is sampled and retained at each of the two respective duty cycles. Two empirical data pairs 202 and 204 are thus defined for the air pressure control loop of the dryer 320. Sampling the signaling 104 can include digitally quantifying a signal value, receiving a digitally-encoded value, sampling-and-holding an analog value, or another suitable action.

At 406, a parabolic curve is fitted through the plural empirical data pairs. In the present example, the pressure controller 102 determines coefficient values so as to fit a parabolic curve through the origin and the two empirical data pairs 202 and 204 determined at 404 above. A non-linear fit function is thus defined.

At 408, plural additional data pairs are calculated using the parabolic fit curve. In the present example, the pressure controller 102 uses the parabolic fit (function) to calculate nine additional air pressure values, corresponding to nine respective fan duty cycle values, resulting in nine derived data pairs. Thus, including the origin, a total of twelve data pairs have been determined for the pressure control loop of the dryer 320.

At 410, a lookup table is populated with the empirical and derived data pairs. In the present example, the pressure controller 102 constructs or defines a lookup table 114 including the twelve data pairs and stores the lookup table 114 in machine-accessible storage media. The present pressure loop calibration procedure for the dryer 320 is now complete.

At 412, normal printing operations are begun. In the present example, the printer 308 signals the computer 302 that it is ready to print. The computer 308 responds by transmitting a document file to the master controller 310 of the printer 308 by way of electronic signaling.

At 414, a pressure needed for operation is determined. In the present example, the pressure controller 102 determines or references a sheet media type, ink media type, or other relevant characteristics in accordance with the just-received document file. The pressure controller 102 uses the ink/media type or other suitable information to determine an air pressure to be provided within the manifold 106. Such an air pressure determination can be made by way of a predefined function, reference to a digitally-encoded table of information, or by way of another suitable procedure or resource.

At 416, a duty cycle is estimated by interpolation within the lookup table. In the present example, the pressure controller 102 accesses the lookup table 114 and determines a present fan duty cycle by interpolation between respective data pairs (e.g., 202, 204, 208). Such interpolation, for instance, can select a first data pair whose pressure value is lesser than the air pressure determined at 414 above, and a second data pair whose pressure value is greater than the determined air pressure. Interpolation is then performed by the pressure controller 102 to estimate a duty cycle.

At 418, the fan or fans is/are operated at the estimated duty cycle. In the present example, the pressure controller 102 provides PWM signaling 110 to the fan(s) 112 in accordance with the estimated duty cycle.

At 420, it is determined if the resulting air pressure is OK. In the present example, the pressure controller 102 receives pressure-related signaling 104 from the pressure sensor 108 and compares that sensed pressure value with the determined (desired or set-point) pressure value. If the sensed pressure value is within a tolerance of the determined pressure, than the method proceeds to step 422. If the sensed pressure value is not within tolerance of the determined pressure, than the method proceeds to step 424.

At 422, it is determined if a new operating pressure is needed. In the present example, the pressure controller 102 determines if a new air pressure is needed within the manifold 106. Such a determination can be based upon signaling from the master controller 310 regarding a change in sheet or ink media type, a sensed change in atmospheric conditions, or other suitable criteria. If a new air pressure is needed, the method proceeds back to step 414 above. If a new air pressure is not needed, the method proceeds back to step 418 above.

At 424, the estimated duty cycle is increased or decreased by an incremental value. In the present example, the pressure controller 102 increases the estimated duty cycle by an incremental value if the sensed pressure value is lesser than the determined pressure value minus the tolerance. Otherwise, the pressure controller decreases the estimated duty cycle by an incremental value because (by process of elimination) the sensed pressure value is greater than the determined pressure value plus the tolerance. In one example, an incremental value of 0.5% of duty cycle is used. Other suitable incremental values can also be used. The method then proceeds back to step 418 above.

In general, the present teachings contemplate systems, elements and methods for controlling heated air-drying of printed sheet media or other entities. An air dryer includes an air heating servo loop and a pressure control servo loop respectively active upon air flow through a manifold. The air heating servo loop warms (or heats) air in the manifold and maintains the air temperature at or about a set-point value based upon feedback signaling from a temperature sensor.

A pressure servo loop includes a fan or fans that are controlled by way of a PWM signal according to a present air pressure set-point. The fan(s) drive air flow through the manifold, over the heater and temperature sensor, and into a zone sensed by a pressure sensor. The heated air flows through a plurality of ports out of the manifold and onto a sheet media or other entity. A pressure controller receives signaling from the pressure sensor and adjusts the PWM fan control signal according to a set-point value. The set-point pressure can be determined according to a sheet media type to be dried, an ink or inks to be dried or cured on the media, or other parameters.

The pressure controller performs an automated calibration procedure that determines some number of fan duty cycle/air pressure data pairs by empirical measurement. A parabolic (or other) function is used to fit a curve through the empirical data pairs and a number of additional derived data pairs are calculated. The empirical and derived data pairs define a lookup table that is used during normal media drying operations.

The pressure controller can interpolate between data pairs in the lookup table to estimate a fan duty cycle correlated to a desired air pressure. The pressure controller can also incrementally increase or decrease the fan duty cycle to bring the resulting air pressure back to within tolerance of a desired air pressure (set-point) value, Improved drying or curing of printed media or other entities can be provided accordingly, and consistent performance is provided despite aging or wear-related degradation of the fan or fans within the air dryer, and so on.

In general, the foregoing description is intended to be illustrative and not restrictive, Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. A method performed using a controller for a drying system, comprising:

driving a fan at a plurality of distinct duty cycles;

correlating each of the duty cycles with a resulting air pressure to define empirical data pairs;

calculating derived data pairs by way of a parabolic curve fit through the empirical data pairs;

defining a lookup table including the empirical data pairs and the derived data pairs; and operating the fan in accordance with a media to be dried by way of the lookup table.

2. The method according to claim 1 further comprising:

determining an air pressure for drying a media;

estimating a duty cycle corresponding to the determined air pressure by way of interpolating between two respective data pairs of the lookup table; and operating the fan at the estimated duty cycle.

3. The method according to claim 1 further comprising:

determining an air pressure for drying a media;

operating the fan at a present duty cycle when a resulting air pressure is within a tolerance of the determined air pressure;

incrementally increasing the present duty cycle of the fan when the resulting air pressure is lesser than the determined air pressure minus the tolerance; and incrementally decreasing the present duty cycle of the fan when the resulting air pressure is greater than the determined air pressure plus the tolerance.

4. The method according to claim 1 further comprising:

sensing an air pressure within a manifold of the drying system using a sensor; and providing a signal corresponding to the air pressure from the sensor to the controller.

5. The method according to claim 1, the operating the fan performed by way of a pulse width-modulated (PWM) control signal from the controller.

6. The method according to claim 1, the media being sheet media bearing ink applied by an ink jetting engine.

7. The method according to claim 1, the driving and the correlating and the calculating and the defining performed as part of a startup calibration procedure for a printing device.

8. A system, comprising:

a pressure sensor to sense static pressure within a manifold of an air-based media dryer and provide a corresponding signal;

a fan to drive air flow through the manifold;

a controller coupled to the pressure sensor and the fan, the controller to operate the fan at a plurality of duty cycles and correlate each with a resulting pressure to define respective empirical data pairs, the controller to derive one or more data pairs using a parabolic curve fit through the empirical data pairs, the controller to define a lookup table including the empirical and the derived data pairs, the controller to control the fan by way of the lookup table.

9. The system according to claim 8 further comprising a print engine to form images on sheet media using ink, the controller to determine a pressure for drying the ink on the media, the controller to determine a duty cycle corresponding to the determined pressure by interpolating between respective data pairs within the lookup table, the controller to operate the fan at the determined duty cycle.

10. The system according to claim 8, the controller to determine a pressure for drying ink on the media, the controller to operate the fan at a present duty cycle when a resulting pressure is within a tolerance of the determined pressure, the controller to incrementally increase the present duty cycle when the resulting pressure is lesser than the determined pressure minus the tolerance, the controller to incrementally decrease the present duty cycle when the resulting pressure is greater than the determined pressure plus the tolerance.

11. The system according to claim 8, the controller defining a pressure controller, the system further comprising:

a heater to heat air provided to the manifold;

a temperature sensor to sense temperature of the heated air and provide a corresponding signal; and a temperature controller to control operation of the heater according to the temperature signal, the temperature controller operating independently of the pressure controller.

12. The system according to claim 11, air flowing through the manifold encountering the fan and then the heater and then the temperature sensor and then the pressure sensor.

13. The system according to claim 8 further comprising the manifold, the manifold characterized by a plurality of ports for jetting heated air onto a sheet media, the manifold spanning a width aspect of the sheet media.

14. A printing apparatus, comprising:

a master controller;

a print engine for forming images on sheet media using ink, the print engine controlled by the master controller;

an air-based dryer for drying ink deposited onto sheet media and coupled to the master controller, the air-based dryer including a pressure controller and a temperature controller, the pressure controller to generate a lookup table of empirical data pairs and derived data pairs, each data pair including a fan duty cycle correlated to an air pressure value, the pressure controller to use the lookup table to control air pressure within the air dryer during operation of the printing apparatus.

15. The printing apparatus according to claim 14, the pressure controller to fit a parabolic curve through the empirical data pairs, the pressure controller to calculate the derived data pairs by way of the parabolic curve.

* * * * *